US005653312A

United States Patent [19]

Kato

[11] Patent Number: 5,653,312

[45] Date of Patent: Aug. 5, 1997

[54] ELEVATOR GOVERNOR

[75] Inventor: Kunio Kato, Inazawa, Japan

[73] Assignee: Mitsubishi Denki Kabushiki Kaisha, Tokyo, Japan

[21] Appl. No.: 545,093

[22] Filed: Oct. 19, 1995

[30] Foreign Application Priority Data

Oct. 20, 1994 [JP] Japan ..... 6-255596

[51] Int. Cl.[6] ..... B66B 5/00

[52] U.S. Cl. ..... 187/350; 188/188

[58] Field of Search ..... 187/350, 287, 187/288, 373, 374; 188/188, 189

[56] References Cited

U.S. PATENT DOCUMENTS 4,742,891 5/1988 Kunii et al. ..... 187/25

5,299,661 4/1994 Pramanik et al. ..... 187/373

5,492,200 2/1996 Konhonen ..... 187/350

FOREIGN PATENT DOCUMENTS 53-130775 3/1952 Japan .

63-151480 10/1988 Japan .

*Primary Examiner*—Kenneth Noland

*Attorney, Agent, or Firm*—Leydig, Voit & Mayer

[57] ABSTRACT

An elevator governor has two balancing springs, i.e., a first balancing spring for continually urging flyweights in a direction against a centrifugal force and a second balancing spring for urging flyweights in a direction against the centrifugal force only when speed of a cage exceeds a previously set first overspeed. Thereby, two overspeeds may be set independently from each other whereby the setting operation may be facilitated and accuracy in setting the overspeeds may be improved.

6 Claims, 9 Drawing Sheets

ELEVATOR GOVERNOR

BACKGROUND OF THE INVENTION

1. Field of the Invention

The present invention relates to an elevator governor for actuating an emergency stop system by detecting an excessive speed of a cage or a counter weight.

2. Description of the Related Art

FIG. 7 shows a construction of a conventional elevator such as disclosed in Japanese Utility Model Laid-Open No. 63-151480. In FIG. 7, a hoist 3 serving as a driving unit is disposed in a machinery room 2 which is located at an upper portion of an elevator passage 1. A plurality of main ropes 4 are wound around a rope sheave 3*a* on the hoist 3. A cage 5 is connected to one end portion of the main ropes 4 and a counter weight 6 for compensating the weight on the side of the cage 5 is connected to the other end portion of the main ropes 4.

A governor 7 is disposed next to the hoist 3 on the floor of the machinery room 2. An endless governor rope 10 hanging down into the elevator passage 1 is wound around a rope sheave 8 of the governor 7. A tension pulley 9 is suspended at a lower portion of the governor rope 10. Further, the governor rope 10 is connected to a side portion of the cage 5 through an arm 11. Thus, the governor 7 is actuated to slow down or stop the cage 5 when speed of the cage 5 has exceeded a prescribed speed.

A conventional governor will now be described in detail. FIG. 8 is a front view of certain portions showing an example of conventional elevator governors and FIG. 9 is a longitudinal sectional view thereof. In these figures, the sheave 8 having the governor rope 10 wound around thereon is supported on a stand 12 in a manner rotatable about a sheave shaft 13. A pair of flyweights 15 capable of being turned respectively about pins 14 are attached to side surfaces of the sheave 8. The pair of flyweights 15 are linked with each other by means of a link 16.

An actuating piece 15*a* consisting of a bolt is screwed into one end portion (toward the center of gravity) of each flyweight 15. Each flyweight 15 is turned about the pin 14 such that the respective moving piece 15*a* is moved radially outward of the sheave 8 due to a centrifugal force resulting from a rotation of the sheave 8. A balancing spring 17 for providing a force against the centrifugal force is provided between the other end portion of one of the flyweights 15 and the sheave 8. A cage stopping switch 19 having an actuating arm 19*a* which faces the actuating piece 15*a* is secured on the stand 12 by way of a fixture 18.

A pawl 15*b* is provided on the other end portion of each flyweight 15. A ratchet 21 is supported as fitted rotatably on a bearing of a bearing portion 12*a* of the stand 12. Provided on the ratchet 21 are teeth 21*a* for engaging the pawl 15*b* only when the sheave 8 is rotated in one particular direction. Further, a rope catch holding hook 22 is provided on the ratchet 21 to hold a rope catch 23.

The operation will now be described. The sheave 8 is rotated as the governor rope 10 travels in synchronization with the going up and down of the cage 5. At this time, the flyweights 15 receive a centrifugal force corresponding to the rotating speed of the sheave 8, i.e., speed of the cage 5 while revolving together with the sheave 8. When speed of the cage 5 has exceeded a predetermined value, the flyweights 15 are turned about the pins 14 against the force of the balancing spring 17.

Further, when the speed of going up and down of the cage 5 has become a first overspeed (normally about 1.3 times the rated speed) which is higher than the predetermined value, the actuating piece 15*a* abuts the actuating arm 19*a* of the cage stopping switch 19 due to displacement of the flyweights 15 and turns the actuating arm 19*a*. Thereby the switch 19 is actuated so that the power of the hoist 3 is cut off and the cage is stopped.

Further, for example when the main ropes 4 are broken, the cage 5 continues to go down without coming to a stop even though the hoist 3 has been stopped. When the cage reaches a second overspeed (normally about 1.4 times the rated speed), the flyweights 15 are furthermore displaced due to a centrifugal force resulting from the rotation of the sheave 8 corresponding to such speed and the pawl 15*b* is caused to engage the ratchet 21. Since, thereby, the ratchet 21 is rotated in synchronization with the sheave 8 to cause a rotation of the rope catch holding hook 22 provided on the ratchet 21, the engagement between the rope catch holding hook 22 and the rope catch 23 is released. The governor rope 10 is braked by the rope catch 23 and, in a linked connection with this, an emergency stopping system (not shown) provided on the cage 5 is operated to bring the cage 5 to a sudden stop.

FIG. 10 shows a conventional elevator governor such as the one disclosed in Japanese Utility Model Laid-Open No. 54-20465. In FIG. 10, a fixed rope catch 24 is screwed onto the stand 12. Further, a notch 26 is provided in the stand 12 at the lowermost portion in the operating range of a movable rope catch 25.

If the movable rope catch 25 is to be restored after its operation due to the above described second overspeed where it is dropped to the lowermost end portion within its operating range, a rod (not shown) is inserted from the notch 26 provided on the stand 12 to lift the movable rope catch 25.

As disclosed for example in Japanese Patent Publication No. 4-28622, in order to suppress a vibration-like turning of the flyweights 15 in the conventional elevator governor, a spring constant of the balancing spring 17 must be adjusted such that the flyweight 15 starts its turning before reaching the first overspeed of the governor when the rated speed has been exceeded and that the flyweight 15 causes a rotation of the ratchet 21 at a second overspeed. There has been a problem that setting of an operating speed is difficult.

Further, since a gap occurs around the respective pins of the flyweights 15 and the link 16, there has been a problem that the flyweight 15 is shaken up at the time of rotation of the sheave 8 and the detected overspeed is not stable. Furthermore, when causing the rope catch holding hook 22 of the ratchet 11 to hold the rope catch 23, positioning is necessary of the rope catch 23 with respect to the rope catch holding hook 22. There is thus a problem that the restoring operation (holding operation) of the rope catch 23 is complicated and takes time.

Moreover, since it is to be restored from the side of the movable rope catch 25, there has been a problem that a restoring operation of the rope catch 23 is difficult when a gap between the governor 7 and a wall of the machinery room 2 which constitutes a working space and a gap between the governor 7 and the hoist 3 on the opposite side are narrow.

SUMMARY OF THE INVENTION

To solve the problems as described above, it is an object of the present invention to provide an elevator governor in which: setting of operation speed is easy whereby performing of its assembly is facilitated; a stable overspeed detecting capability may be maintained; and a restoring operation of the rope catch may be readily performed whereby performing of its assembly is facilitated.

To this end, according to one aspect of the present invention, there is provided an elevator governor, comprising: a stand; a sheave supported as rotatable on the stand; a governor rope wound around the sheave so as to rotate the sheave in accordance with a speed of going up and down of a cage; a pair of flyweights attached as turnable on the sheave so as to be turned by a centrifugal force due to a rotation of the sheave; a first balancing spring for continually urging the flyweights in a direction against the centrifugal force; a second balancing spring for urging the flyweights in a direction against the centrifugal force only when the speed of the cage exceeds a previously set first overspeed; a cage stopping switch for stopping a driving system of the cage as operated by the flyweights when the speed of the cage has reached the first overspeed; and a rope catch mechanism for braking the governor rope as operated by the flyweights when the speed of the cage has reached a second overspeed which is higher than the first overspeed.

According to another aspect of the present invention, there is provided an elevator governor, comprising: a stand; a sheave supported as rotatable on the stand; a governor rope wound around the sheave so as to rotate the sheave in accordance with a speed of going up and down of a cage; a pair of flyweights attached as turnable on the sheave so as to be turned by a centrifugal force due to a rotation of the sheave; a balancing spring for urging the flyweights in a direction against the centrifugal force; a cage stopping switch for stopping a driving system of the cage as operated by the flyweights when a speed of the cage has become a previously set first overspeed; a ratchet provided as rotatable about a sheave axis of the sheave and having a disengaging projection projecting in parallel to the sheave axis, the ratchet rotated together with the sheave as operated by the flyweights when speed of the cage has become a second overspeed which is higher than the first overspeed; a hook member hooked on the stand so as to be released from its engagement with the stand as pressed at one end portion thereof by the disengaging projection upon the rotation of the ratchet; a fixed rope catch fixed on the stand; and a movable rope catch linked with the hook member so as to move together with the hook member upon releasing of the engagement of the hook member with the stand for clamping the governor rope between itself and the fixed rope catch.

DETAILED DESCRIPTION OF THE PREFERRED EMBODIMENTS

Some embodiments of the present invention will now be described with reference to the drawings.

Embodiment 1

Figure 1:
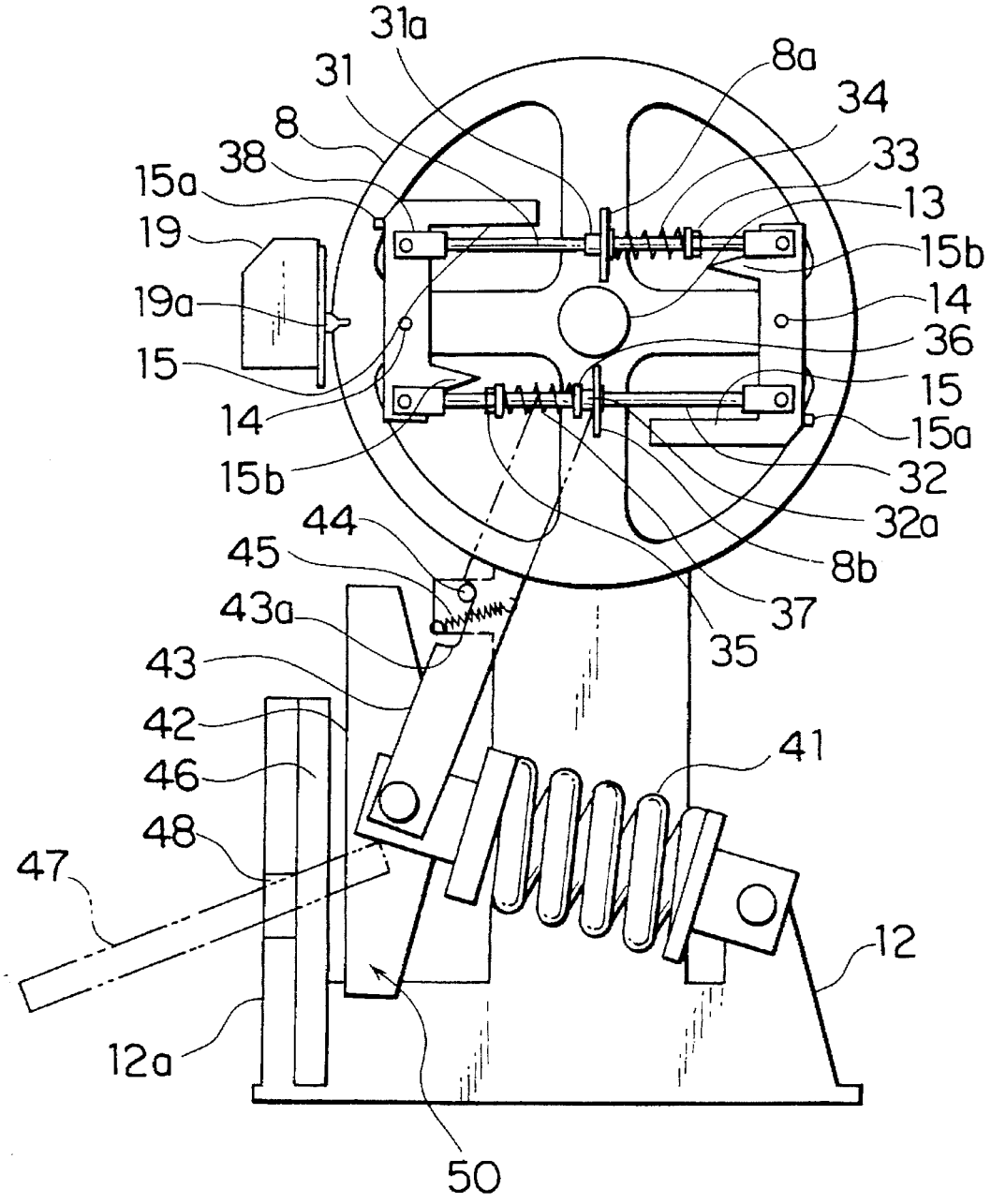
FIG. 1 is a front view showing certain portions of an elevator governor according to Embodiment 1 of the present invention.
Figure 2:
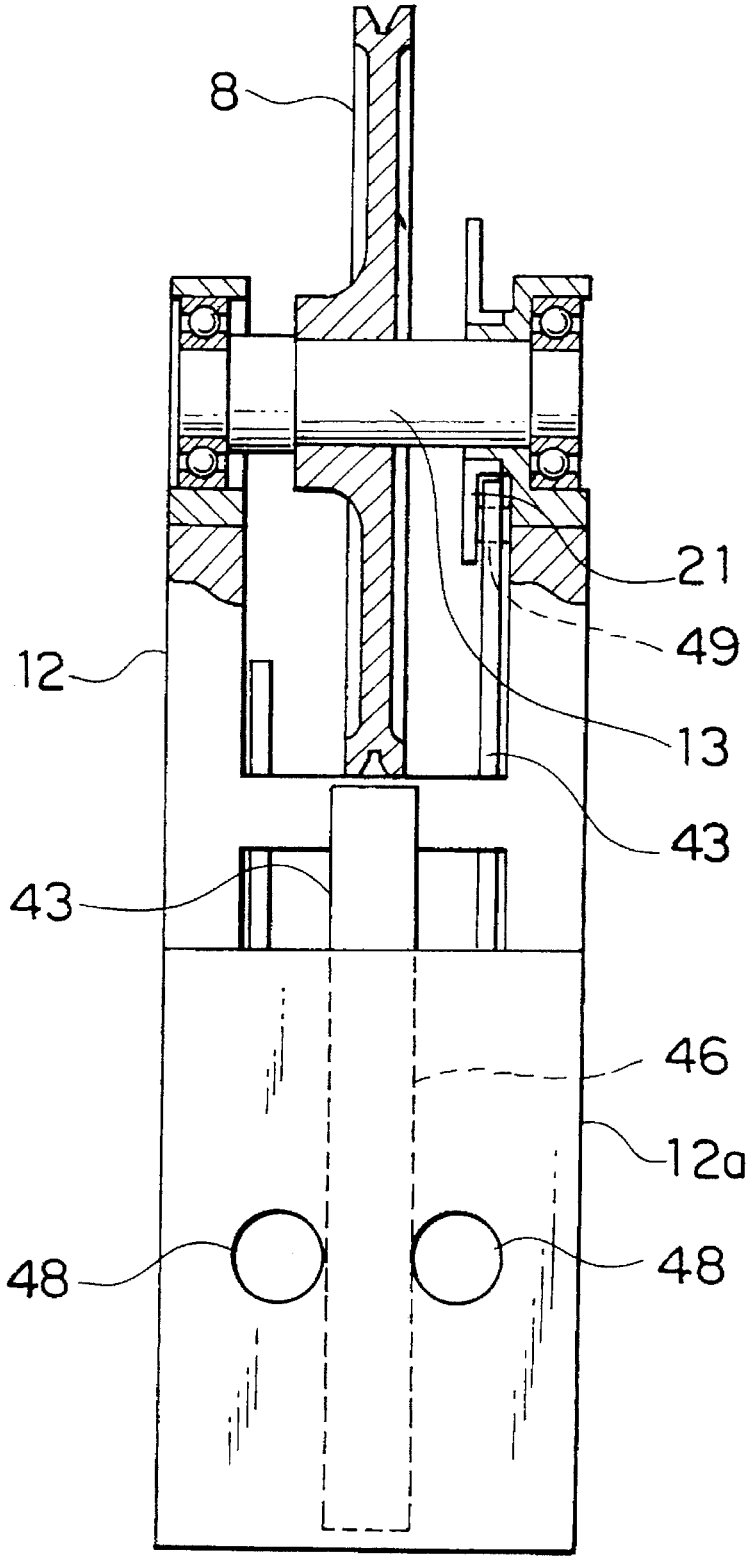
FIG. 2 is a partially fragmental side view of the left side as shown in FIG. 1.
Figure 7:
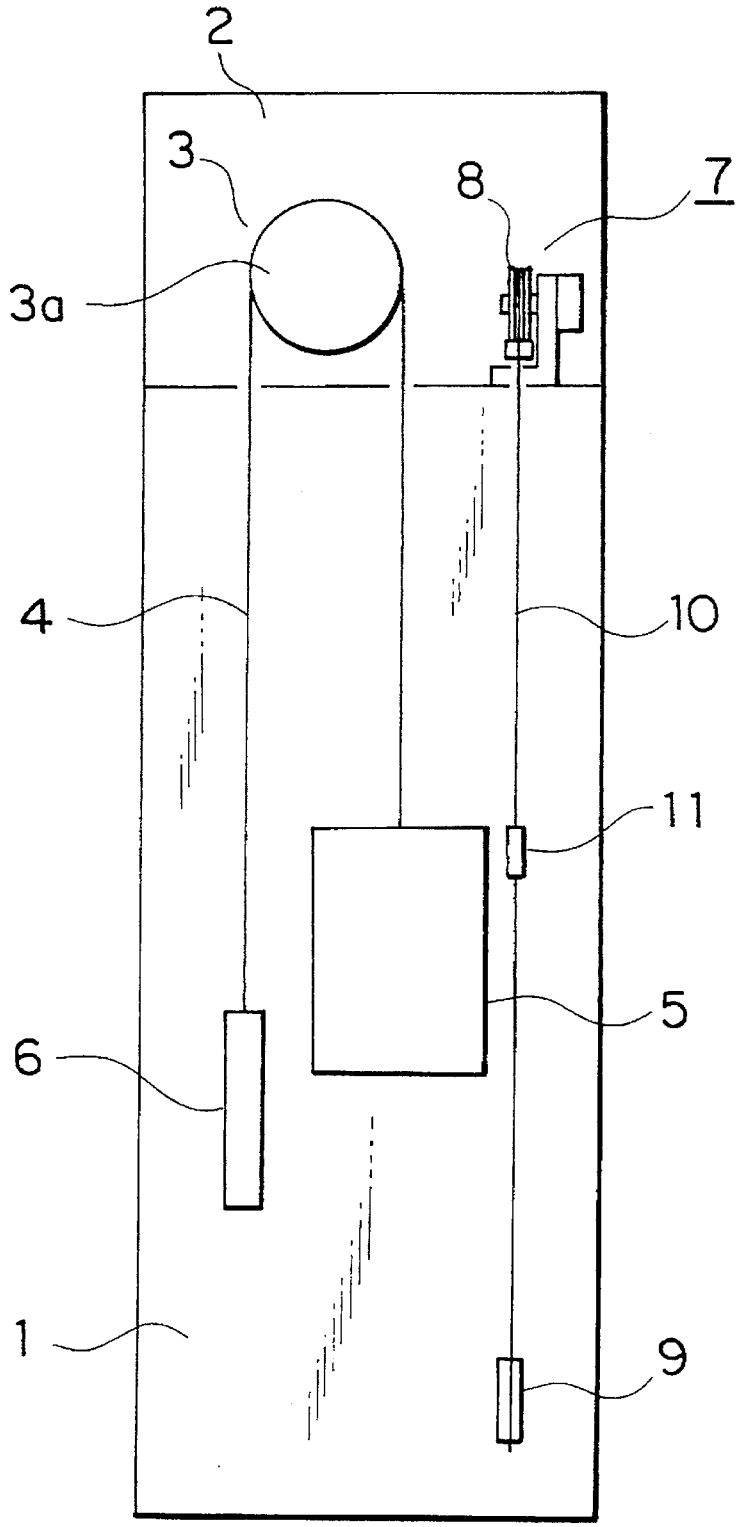
FIG. 7 PRIOR ART
FIG. 7 shows a construction of an example of conventional elevators.
Figure 8:
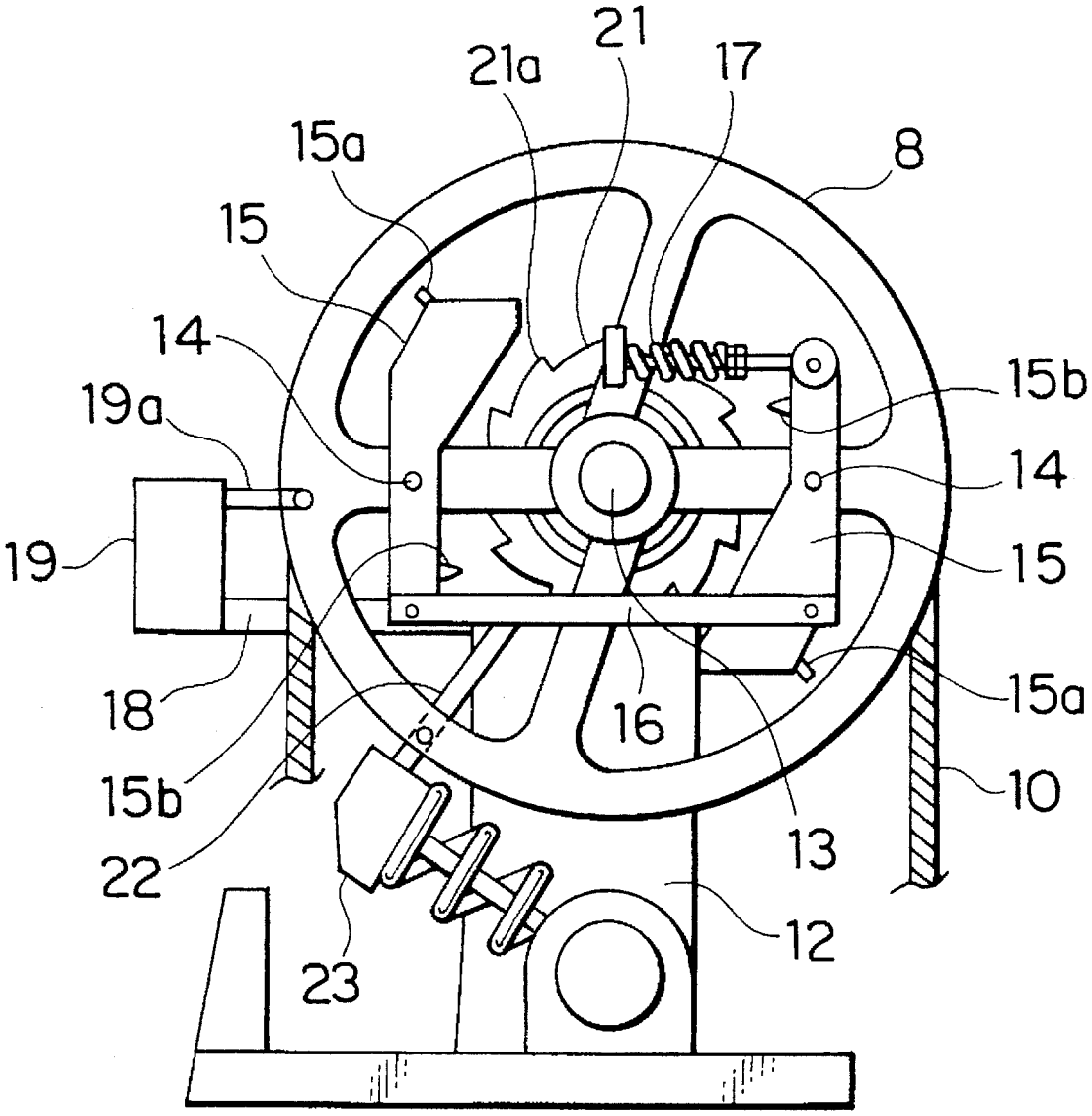
FIG. 8 PRIOR ART
FIG. 8 is a front view showing certain portions of an example of conventional elevator governors.
Figure 9:
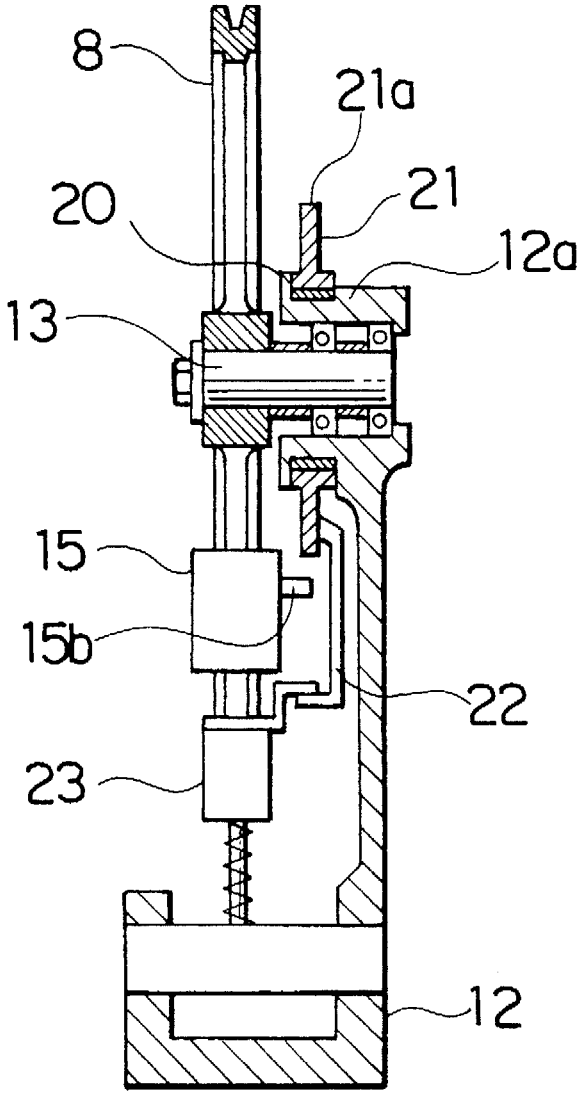
FIG. 9 PRIOR ART
FIG. 9 is a longitudinal sectional view of FIG. 8.
Figure 10:
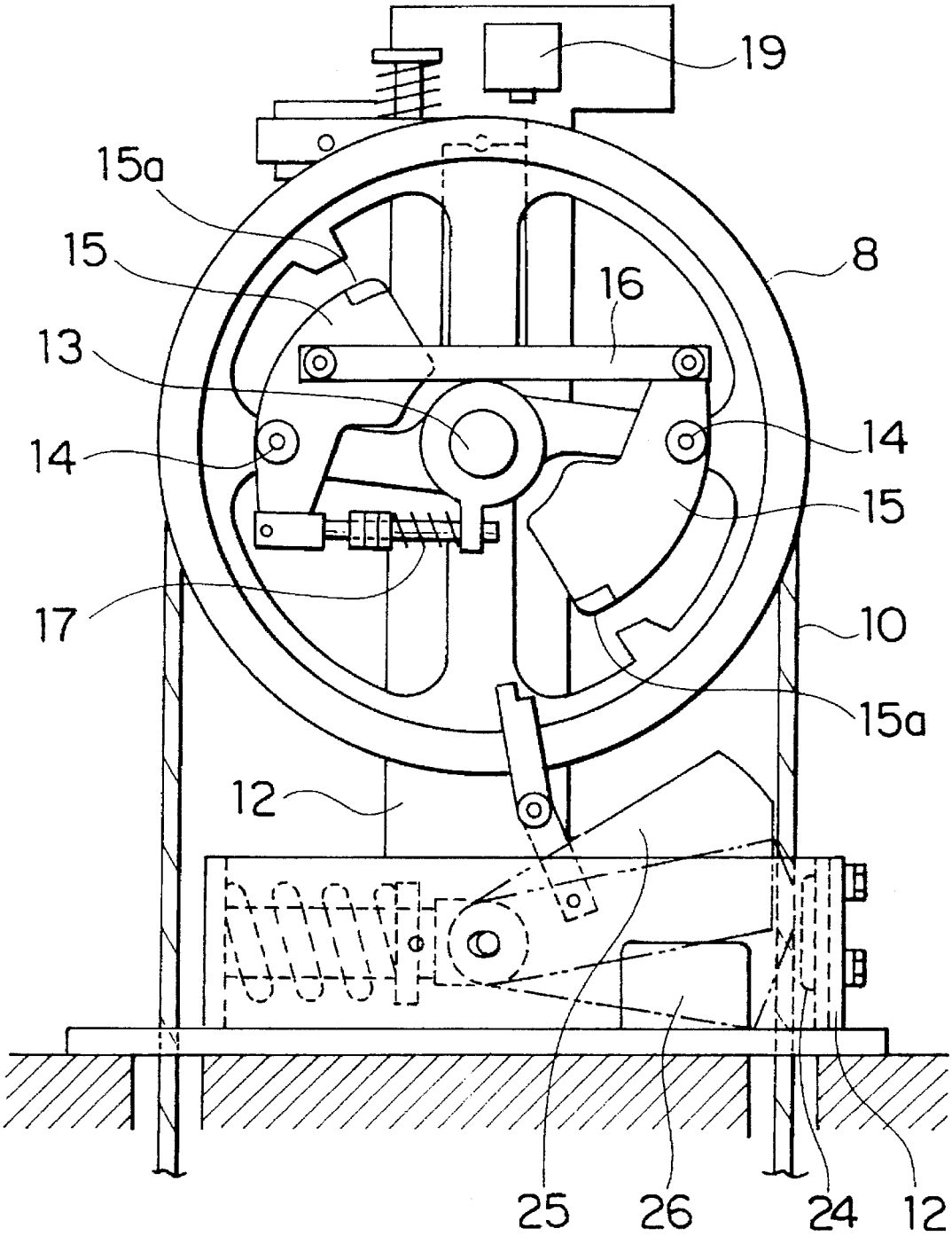
FIG. 10 PRIOR ART
FIG. 10 is a front view showing certain portions of another example of conventional elevator governors.

FIG. 1 is a front view of certain portions of an elevator governor according to Embodiment 1 of the present invention and FIG. 2 is a partially fragmental side view of the left side as shown in FIG. 1. Portions identical corresponding to those in FIGS. 7 to 9 are denoted by the same reference numerals and will not be described.

In FIGS. 1 and 2, stopper plates 8*a*, 8*b* are secured on a side surface portion of the sheave 8. A pair of rods 31, 32 penetrate through the stopper plates 8*a*, 8*b*. Both end portions of each rod 31, 32 are linked with a pair of flyweights 15, thereby constituting a closed link. A first balancing spring 34 for continually urging each flyweight through the rod 31 in a direction against the centrifugal force is provided between the stopper plate 8*a* and a spring force adjusting nut 33 screwed on the rod 31. A collar 31*a* for regulating a traveling of the rod 31 in the direction of urging of the first balancing spring 34 is secured on the rod 31, and the collar 31*a* in its initially set state receives an initial compression spring force (pre-load) of the first balancing spring 34.

The rod 32 has a spring force adjusting nut 35 screwed thereon and a collar 32*a* secured thereon in a manner slidably penetrating through the stopper plate 8*b*. An abutting plate 36 through which the rod 32 slidably penetrates abuts an end surface toward the spring force adjusting nut 35 of the collar 32*a*. A second balancing spring 37 is provided between the spring force adjusting nut 35 and the abutting plate 36. The second balancing spring 37 urges the flyweight 15 in a direction against the centrifugal force only when speed of a cage 5 (see FIG. 7) is exceeding a previously set first overspeed. In particular, the second balancing spring 37 of Embodiment 1 does not act at the first overspeed but acts after reaching a predetermined speed which is higher the first overspeed. For this reason, in the initial state, a predetermined space is provided between the abutting plate 36 and the stopper plate 8*b*, and the collar 32*a* and the abutting plate 36 are to receive a pre-load by the second balancing spring 37.

Further, the rod 31 is linked with the flyweight 15 through a pivot 38. As shown in an enlarged manner in FIG. 3, the rod 31 penetrates through a hole 38*a* of the pivot 38 and a push spring 39 is provided between a head portion 31*b* of the rod 31 and the peripheral edge portion of the hole 38*a*. A tensile force is applied on the rod 31 by the push spring 39 and a pre-load is applied to each of the portions for supporting the turning of the closed link which is constituted by the pair of flyweights 15 and the rods 31, 32.

One end portion of a rope catch spring 41 is attached to the stand 12 in a manner capable of pivoting thereabout. The other end portion of the rope catch spring 41 is attached to a movable rope catch 42 and is linked with a lower end portion of a hook member 43. A recess 43*a* is provided in a middle portion of the hook member 43, the recess 43*a* being engaged with, i.e., hooked on an engaging projection 44 which is provided on the stand 12. An engaging state holding spring (pulling spring) 45 for urging the hook member so as to push the recess 43*a* against the engaging projection 44 is provided between the stand 12 and the hook member 43.

A fixed rope catch 46 opposing the movable rope catch 42 is secured on the stand 12. A through hole 48 for inserting a pushing up rod 47 to be used in restoring the movable rope catch 42 is provided at an portion 12*a* of the stand 12 for attaching the fixed rope catch 46.

Figure 4:
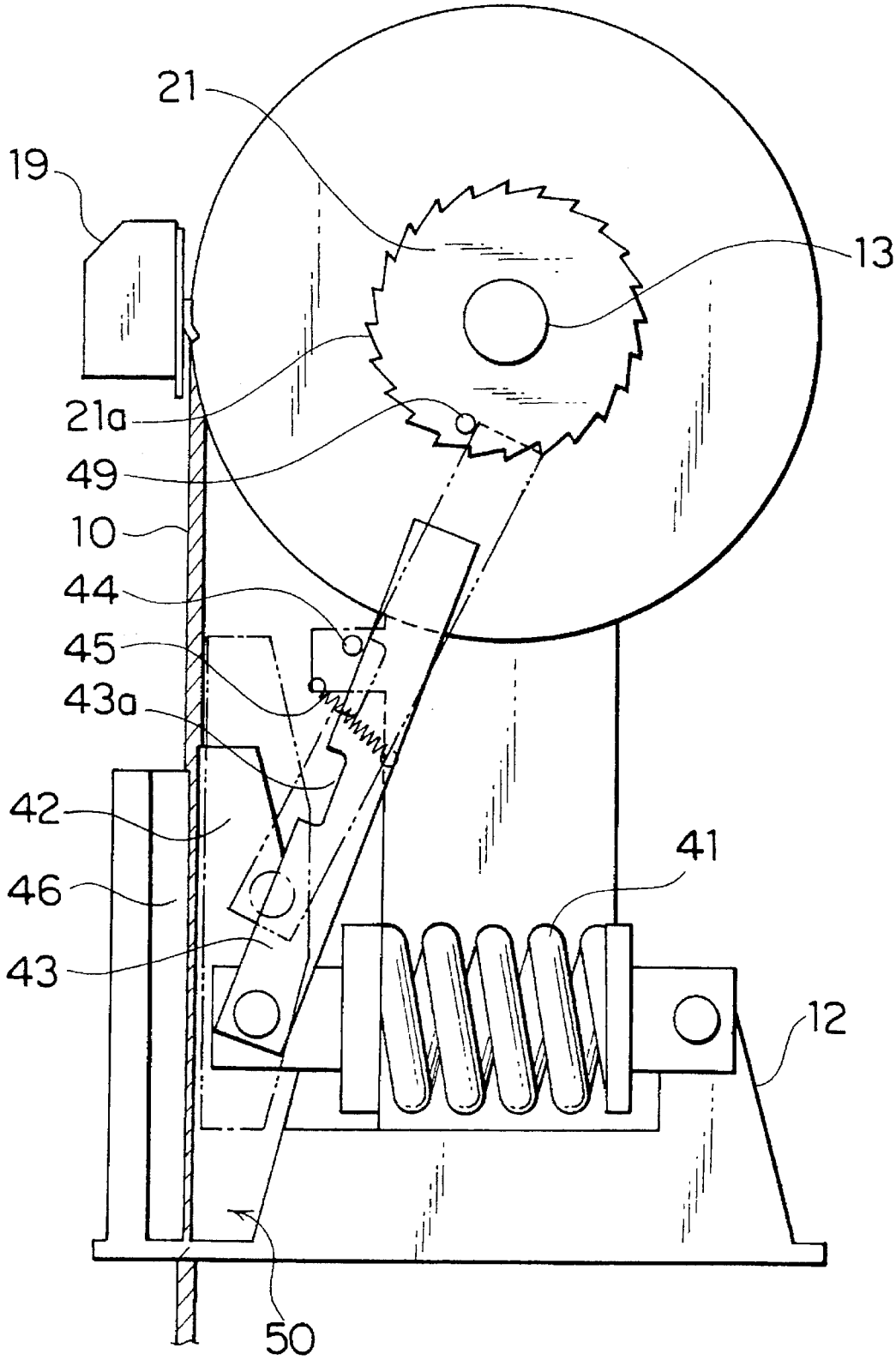
FIG. 4 is a front view showing a state of an operation of a movable rope catch of FIG. 1.

FIG. 4 is a front view showing a state of an operation of the movable rope catch 42 of FIG. 1. A rotatable ratchet 21 is provided on a sheave shaft 13. An engagement releasing projection 49 in parallel with the sheave shaft 13 is secured on a side surface portion of the ratchet 21. Further, a rope catch mechanism 50 of Embodiment 1 is constituted by the ratchet 21, the engagement releasing projection 49, the hook member 43, the engaging projection 44, the engaging state holding spring 45, the movable rope catch 42, the rope catch spring 41 and the fixed rope catch 46.

Figure 5:
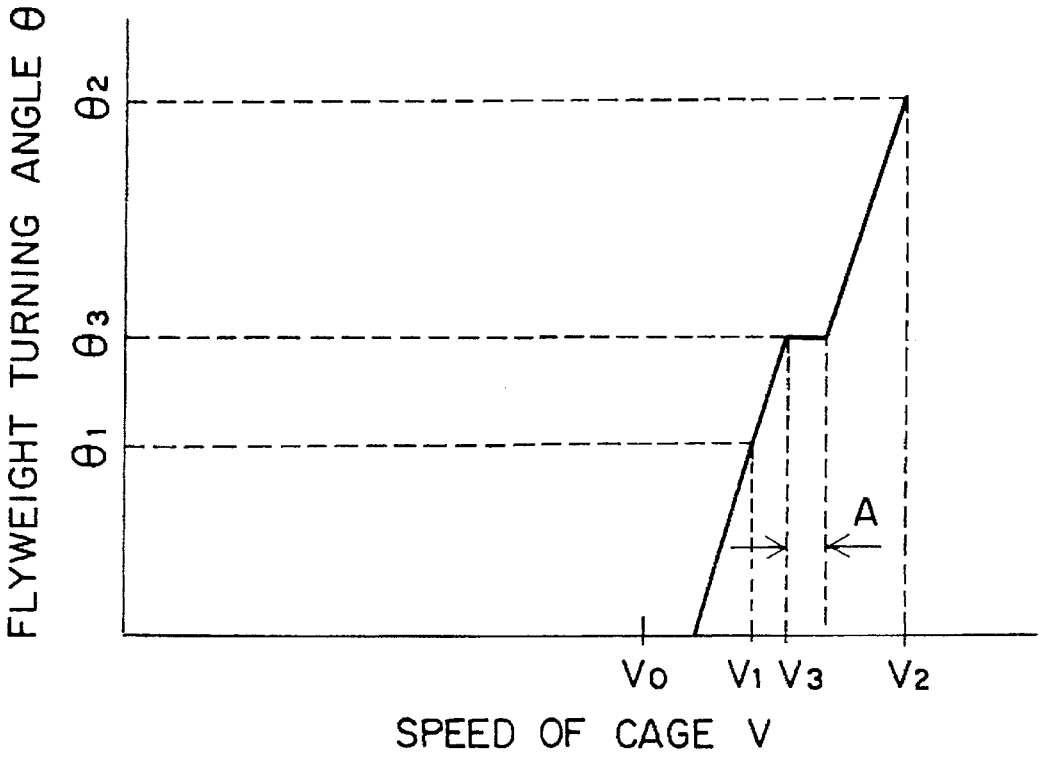
FIG. 5 shows the relation between a speed of a cage and a turning angle of flyweights in the system of FIG. 1.

The operation will now be described. When the sheave 8 is rotated in synchronization with the going up and down of the cage 5, the pair of the flyweights 15 receive a centrifugal force corresponding to the rotating speed of the sheave 8, i.e., the speed of the cage 5. FIG. 5 shows the relation between the speed of the cage and the angle of turning of the flyweights in the system as shown in FIG. 1. Since the predetermined space is provided between the abutting plate 36 and the stopper plate 8*b*, the second balancing spring 37 does not act until the speed the of cage reaches a predetermined speed $V_3$ which is higher than the first overspeed $V_1$. Further, the first balancing spring 34 is previously compressed and it is set so that the flyweights 15 start to rotate after the speed of the cage has exceeded a rated speed $V_0$.

Thereby, when the speed of the cage reaches the first overspeed $V_1$, the turning angle of the flyweights 15 becomes $\theta_1$, whereby the actuating piece 15*a* abuts the actuating arm 19*a* to actuate the cage stopping switch 19 so that power of the hoist 3 (see FIG. 7) is cut off and the cage comes to a complete stop.

Further, when the cage 5 does not stop even though the hoist 3 has stopped and the speed of the cage reaches $v_3$ after exceeding the first overspeed $V_1$, both the first and second balancing springs 34, 37 are caused to act because the abutting plate 36 abuts the stopper plate 8*b*. An interval A in FIG. 5 indicates the fact that the turning of the flyweights 15 is stopped once due to the previous compression of the second balancing spring 37. After passing the interval A, the flyweights 15 are turned again against the force of the first and second balancing springs 34, 37. When the speed of the cage reaches a second overspeed $V_2$, the turning angle of the flyweights 15 becomes $\theta_2$ and the pawl 15*b* engages the ratchet 21.

The ratchet 21 is thereby rotated in synchronization with the sheave 8 so that the engagement releasing projection 49 provided on the ratchet 21 presses the hook member 43. Due to this pressing force, the hook member 43 is displaced as indicated by a two-dot chain line in FIG. 4 whereby the engaged state of the recess 43*a* with the engaging projection 44 is released. As a result, the movable rope catch 42 and the hook member 43 are moved to their position indicated by a solid line in FIG. 4 so that the governor rope 10 is clamped between the movable rope catch 42 and the fixed rope catch 46. Thereby, the governor rope 10 is braked and, in a linked connection with this, an emergency stopping system provided on the cage 5 is operated to bring the cage 5 to a sudden stop.

Thereafter, when the movable rope catch 42 is to be restored to its state as shown in FIG. 1, the pushing up rod 47 is inserted from the through hole 48 to push up the supporting portion of the movable rope catch 42 by a terminal end portion of the pushing up rod 47. The movable rope catch 42 and hook member 43 are thereby moved upward so that the recess 43*a* engages the engaging projection 44. At this time, by the action of the engaging state holding spring 45, the engaging projection 44 is smoothly inserted into the recess 43*a* by simply pushing up the hook member 43.

As described above, since, in the conventional example, setting of the first and second overspeeds are performed by an adjustment of a single balancing spring, the setting operation takes much time and labor and, in addition, setting of the first overspeed tends to be inaccurate. Especially, as the rated speed of the elevator becomes higher, there occurs such problems as that the flyweights start to rotate at a speed lower than the rated speed. According to the governor of Embodiment 1, however, the setting of the first overspeed $v_1$ may be performed by tightening of the spring force adjusting nut 33 of the first balancing spring 34 and the setting of the second overspeed $v_2$ may be performed by tightening of the spring force adjusting nut 35 of the second balancing spring 37. In other words, since the two set overspeeds may be separately set, the setting operation becomes easier to facilitate performing of assembly of the system and accuracy in the set overspeeds is also improved.

Figure 3:
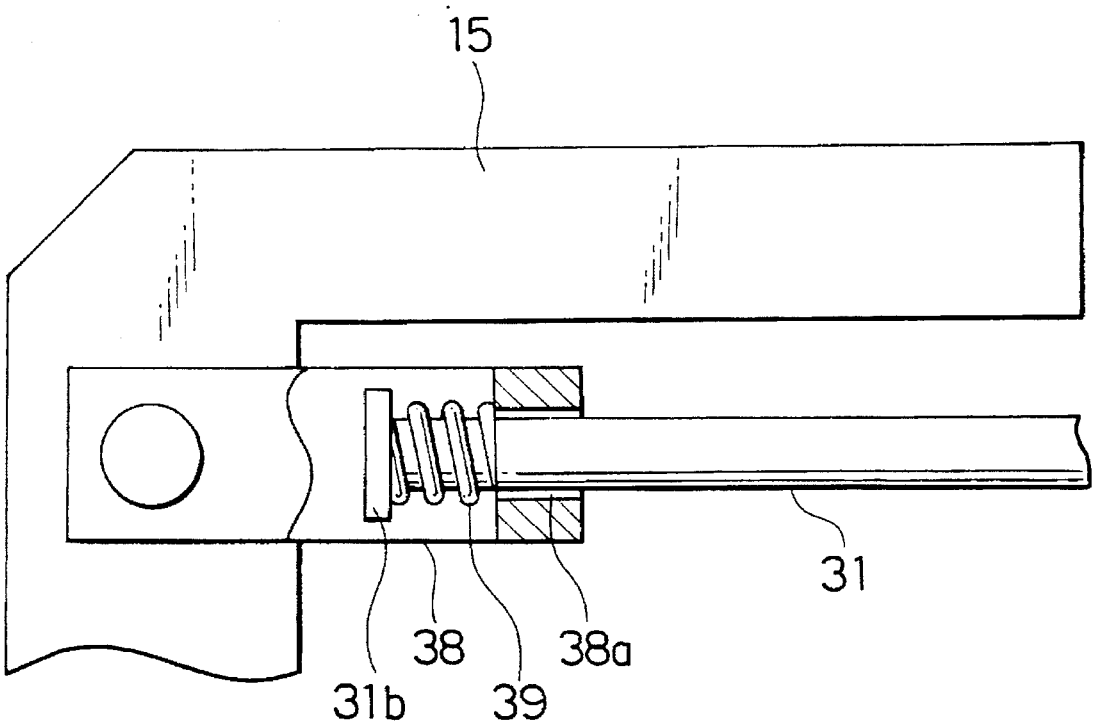
FIG. 3 shows the construction of certain portions of FIG. 1 in an enlarged manner.

Further, as shown in FIG. 3, since a pre-load is applied to each supporting portion of the flyweights 15 and the rods 31, 32 by the push spring 39, shaking of the flyweights 15 is prevented to maintain a stable overspeed detecting capability.

Furthermore, since the hook member 43 linked with the movable rope catch 42 is not engaged by the ratchet 21 but is engaged by the stand 12 which is a fixed member, such as an intricate positioning operation is not necessary whereby restoring operation of the movable rope catch 42 is easier to facilitate assembly of the system.

Moreover, since the engaging state holding spring 45 is provided between the stand 12 and the hook member 43, the restoring operation of the movable rope catch 42 is further facilitated and reliability is improved as an erroneous releasing of the engaged state due to a vibration or the like may be prevented of the recess 43 with the engaging projection 44.

In addition, since the through hole 48 is provided on the attaching portion 12*a* of the stand 12 for the fixed rope catch 46, the restoring operation in restoring the movable rope catch 42 may be readily performed even when the gap is narrow between the governor 7 and a wall of the machinery room 2 (see FIG. 7) and/or between the governor 7 and the hoist 3.

Embodiment 2

Figure 6:
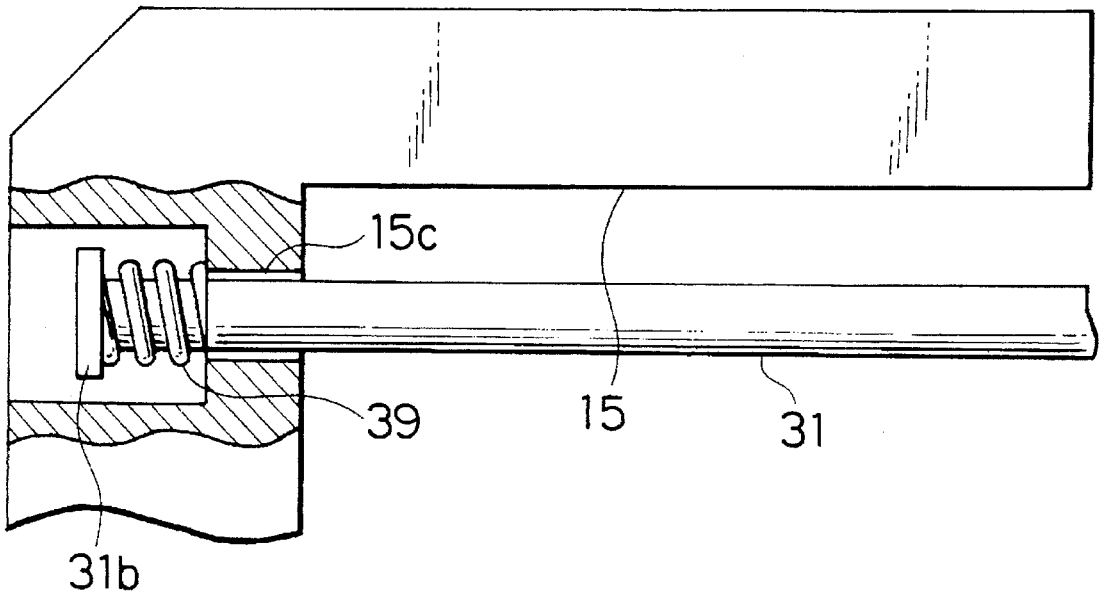
FIG. 6 shows a construction of Embodiment 2 of the present invention.

It should be noted that, while, in Embodiment 1, a pivot 38 is placed between the rod 31 and the flyweight 15, it is also possible for example as shown in FIG. 6 that a hole 15*c* is provided on the flyweight 15 and a push spring 39 is directly provided between the flyweight 15 and the rod 31, achieving a simpler construction.

Further, while, in Embodiment 1, an example is shown of performing an adjustment of the spring force of the balancing springs 34, 37 by the nuts 33, 35, the present invention is not limited to this and it is also possible to perform an adjustment of the spring force for example by inserting a liner between the balancing spring and a portion against which an end portion thereof is abutted.

Furthermore, while, in Embodiment 1, the recess 43*a* of the hook member 43 is engaged by the engaging projection 44 of the stand 12, the engaging structure of the hook member with the stand 12 is not limited to this.

Moreover, while, in Embodiment 1, an example is shown of previously compressing each of the first and second balancing spring 34, 37, amount of such compression may be adjusted correspondingly to a set speed and there can be a state without a previous compression.

What is claimed is:

1. An elevator governor comprising:

a stand;

a sheave supported as rotatable on said stand;

a governor rope wound around said sheave so as to rotate said sheave in accordance with a speed of going up and down of a cage;

a pair of flyweights attached as turnable on said sheave so as to be turned by a centrifugal force due to a rotation of said sheave;

a first balancing spring for continually urging said flyweights in a direction against said centrifugal force;

a second balancing spring for urging said flyweights in a direction against said centrifugal force only when the speed of said cage exceeds a previously set first overspeed;

a cage stopping switch for stopping a driving system of said cage as operated by said flyweights when the speed of said cage has reached the first overspeed; and a rope catch mechanism for braking said governor rope as operated by said flyweights when the speed of said cage has reached a second overspeed which is higher than said first overspeed.

2. An elevator governor according to claim 1 wherein said pair of flyweights are linked with each other by a pair of rods and a spring for applying a pre-load to supporting portions for turning of said flyweights and said rods is provided between said flyweight and said rod.

3. An elevator governor according to claim 2 wherein one end portion of said rod penetrates through said flyweight and said spring is directly provided between said one end portion of said rod and said flyweight.

4. An elevator governor comprising:

a stand;

a sheave supported as a rotatable on said stand;

a governor rope wound around said sheave so as to rotate said sheave in accordance with a speed of going up and down of a cage;

a pair of flyweights attached as turnable on said sheave so as to be turned by a centrifugal force due to a rotation of said sheave;

a balancing spring for urging said flyweights in a direction against said centrifugal force;

a cage stopping switch for stopping a driving system of said cage as operated by said flyweights when a speed of said cage has become a previously set first overspeed;

a ratchet provided as rotatable about a sheave axis of said sheave and having a disengaging projection projecting in parallel to said sheave axis, said ratchet rotated together with said sheave as operated by said flyweights when speed of said cage has become a second overspeed which is higher than said first overspeed;

a hook member hooked on said stand so as to be released from its engagement with said stand as pressed at one end portion thereof by said disengaging projection upon the rotation of said ratchet;

a fixed rope catch fixed on said stand; and a movable rope catch linked-with said hook member so as to move together with said hook member upon releasing of the engagement of said hook member with said stand for clamping said governor rope between itself and said fixed rope catch.

5. An elevator governor according to claim 4, further comprising an engaging state holding spring provided between said stand and said hook member, for urging said hook member toward the direction for holding the engaged state of said hook member with said stand.

6. An elevator governor according to claim 5 wherein a through hole for inserting a pushing up rod to be used in restoring said movable rope catch is provided at a portion of said stand for attaching said fixed rope catch.

* * * * *

UNITED STATES PATENT AND TRADEMARK OFFICE

CERTIFICATE OF CORRECTION

PATENT NO. : 5,653,312

DATED : August 5, 1997

INVENTOR(S) : KATO

It is certified that error appears in the above-indentified patent and that said Letters Patent is hereby corrected as shown below:

Column 7, Line 38 , after "as" delete --a--.

Signed and Sealed this

Twenty-third Day of December, 1997

Bruce Lehman

*Attest:*

BRUCE LEHMAN

*Attesting Officer*

*Commissioner of Patents and Trademarks*